US008251003B2

(12) United States Patent
Vandenworm

(10) Patent No.: US 8,251,003 B2
(45) Date of Patent: Aug. 28, 2012

(54) OFFSHORE BUOYANT DRILLING, PRODUCTION, STORAGE AND OFFLOADING STRUCTURE

(75) Inventor: Nicolaas J. Vandenworm, Houston, TX (US)

(73) Assignee: SSP Technologies, Inc., Grand Cayman (KY)

( * ) Notice: Subject to any disclaimer, the term of this patent is extended or adjusted under 35 U.S.C. 154(b) by 117 days.

(21) Appl. No.: 12/914,709

(22) Filed: Oct. 28, 2010

(65) Prior Publication Data

US 2011/0107951 A1 May 12, 2011

Related U.S. Application Data

(60) Provisional application No. 61/259,201, filed on Nov. 8, 2009, provisional application No. 61/262,533, filed on Nov. 18, 2009.

(51) Int. Cl.
*B63B 21/00* (2006.01)

(52) U.S. Cl. ..... 114/230.2

(58) Field of Classification Search ..... 114/230.2
See application file for complete search history.

(56) References Cited

U.S. PATENT DOCUMENTS

| | | | | |
|---|---|---|---|---|
| 2,771,617 | A * | 11/1956 | Brackx | 441/4 |
| 3,074,082 | A | 7/1959 | Griebe | |
| 3,822,663 | A * | 7/1974 | Boschen, Jr. | 114/293 |
| 4,048,943 | A * | 9/1977 | Gerwick, Jr. | 114/256 |
| 4,108,102 | A | 8/1978 | Lindstrom | |
| 4,735,167 | A | 4/1988 | White et al. | |
| 5,065,687 | A | 11/1991 | Hampton | |
| 5,702,206 | A | 12/1997 | Quenan et al. | |
| 6,340,272 | B1 | 1/2002 | Runge et al. | |
| 6,340,273 | B1 | 1/2002 | Hull | |
| 6,371,697 | B2 | 4/2002 | Huang et al. | |
| 6,431,107 | B1 | 8/2002 | Byle | |

(Continued)

FOREIGN PATENT DOCUMENTS

EP 1178922 B1 2/2002

OTHER PUBLICATIONS

PCT Written Opinion and Search Report of corresponding counterpart international application No. PCT/US2010-054404 dated Jan. 11, 2011.

*Primary Examiner* — Stephen Avila
(74) *Attorney, Agent, or Firm* — Gary L. Bush; Brett T. Cooke; Andrews Kurth LLP

(57) ABSTRACT

An offshore structure having a vertically symmetric hull, an upper vertical wall, an upper inwardly-tapered wall disposed below the upper vertical wall, a lower outwardly-tapered wall disposed below the upper sloped wall, and a lower vertical wall disposed below the lower sloped wall. The upper and lower sloped walls produce significant heave damping in response to heavy wave action. A heavy slurry of hematite and water ballast is added to the lower and outermost portions of the hull to lower the center of gravity below the center of buoyancy. The offshore structure provides one or more movable hawser connections that allow a tanker vessel to moor directly to the offshore structure during offloading rather than mooring to a separate buoy at some distance from the offshore storage structure. The movable hawser connection includes an arcuate rail with a movable trolley that provides a hawser connection point that allows vessel weathervaning.

1 Claim, 8 Drawing Sheets

U.S. PATENT DOCUMENTS

| | | | | |
|---|---|---|---|---|
| 6,739,804 | B1 | 5/2004 | Haun | |
| 6,761,508 | B1 | 7/2004 | Haun | |
| 6,782,950 | B2 | 8/2004 | Amin et al. | |
| 6,827,160 | B2 | 12/2004 | Blair et al. | |
| 6,942,427 | B1 | 9/2005 | Srinivasan | |
| 6,945,736 | B2 | 9/2005 | Smedal et al. | |
| 6,976,443 | B2 | 12/2005 | Oma et al. | |
| 7,086,810 | B2 | 8/2006 | Masetti et al. | |
| 7,431,622 | B2 | 10/2008 | Haun | |
| 7,500,787 | B2 | 3/2009 | Cioceanu | |
| 7,958,835 | B2 * | 6/2011 | Srinivasan | 114/264 |
| 2004/0240946 | A1 | 12/2004 | Haun | |
| 2004/0258484 | A1 | 12/2004 | Haun | |
| 2005/0212285 | A1 | 9/2005 | Haun | |
| 2005/0277344 | A1 | 12/2005 | Haun | |
| 2009/0078632 | A1 * | 3/2009 | Gallo et al. | 210/178 |
| 2009/0126616 | A1 | 5/2009 | Srinivasan | |
| 2009/0158988 | A1 * | 6/2009 | Ding et al. | 114/266 |

* cited by examiner

OFFSHORE BUOYANT DRILLING, PRODUCTION, STORAGE AND OFFLOADING STRUCTURE

CROSS REFERENCE TO RELATED APPLICATION

This application is based upon provisional application 61/259,201 filed on Nov. 8, 2009 and upon provisional application 61/262,533 filed on Nov. 18, 2009, which are incorporated herein by reference and the priorities of which are claimed.

BACKGROUND OF THE INVENTION

1. Field of the Inventions

This present invention pertains generally to offshore buoyant vessels, platforms, caissons, buoys, spars, or other structures used for petrochemical storage and tanker loading. In particular, the present invention relates to hull and offloading system designs for floating storage and offloading (FSO), floating production, storage and offloading (FPSO) or floating drilling, production, storage and offloading (FDPSO) structures, floating production/process structures (FPS), or floating drilling structures (FDS).

2. Background Art

Offshore buoyant structures for oil and gas production, storage and offloading are known in the art. Offshore production structures, which may be vessels, platforms, caissons, buoys, or spars, for example, each typically include a buoyant hull that supports a superstructure. The hull includes internal compartmentalization for storing hydrocarbon products, and the superstructure provides drilling and production equipment, crew living quarters, and the like.

A floating structure is subject to environmental forces of wind, waves, ice, tides, and current. These environmental forces result in accelerations, displacements and oscillatory motions of the structure. The response of a floating structure to such environmental forces is affected not only by its hull design and superstructure, but also by its mooring system and any appendages. Accordingly, a floating structure has several design requirements: Adequate reserve buoyancy to safely support the weight of the superstructure and payload, stability under all conditions, and good seakeeping characteristics. With respect to the good seakeeping requirement, the ability to reduce vertical heave is very desirable. Heave motions can create alternating tension in mooring systems and compression forces in the production risers, which can cause fatigue and failure. Large heave motions increase riser stroke and require more complex and costly riser tensioning and heave compensating systems.

The seakeeping characteristics of a buoyant structure are influenced by a number of factors, including the waterplane area, the hull profile, and the natural period of motion of the floating structure. It is very desirable that the natural period of the floating structure be either significantly greater than or significantly less than the wave periods of the sea in which the structure is located, so as to decouple substantially the motion of the structure from the wave motion.

Vessel design involves balancing competing factors to arrive at an optimal solution for a given set of factors. Cost, constructability, survivability, utility, and installation concerns are among many considerations in vessel design. Design parameters of the floating structure include the draft, the waterplane area, the draft rate of change, the location of the center of gravity ("CG"), the location of the center of buoyancy ("CB"), the metacentric height ("GM"), the sail area, and the total mass. The total mass includes added mass—i.e., the mass of the water around the hull of the floating structure that is forced to move as the floating structure moves. Appendages connected to the structure hull for increasing added mass are a cost effective way to fine tune structure response and performance characteristics when subjected to the environmental forces.

Several general naval architecture rules apply to the design of an offshore vessel. The waterplane area is directly proportional to induced heave force. A structure that is symmetric about a vertical axis is generally less subject to yaw forces. As the size of the vertical hull profile in the wave zone increases, wave-induced lateral surge forces also increase. A floating structure may be modeled as a spring with a natural period of motion in the heave and surge directions. The natural period of motion in a particular direction is inversely proportional to the stiffness of the structure in that direction. As the total mass including added mass) of the structure increases, the natural periods of motion of the structure become longer.

One method for providing stability is by mooring the structure with vertical tendons under tension, such as in tension leg platforms. Such platforms are advantageous, because they have the added benefit of being substantially heave restrained. However, tension leg platforms are costly structures and, accordingly, are not feasible for use in all situations.

Self-stability (i.e., stability not dependent on the mooring system) may be achieved by creating a large waterplane area. As the structure pitches and rolls, the center of buoyancy of the submerged hull shifts to provide a righting moment. Although the center of gravity may be above the center of buoyancy, the structure can nevertheless remain stable under relatively large angles of heel. However, the heave seakeeping characteristics of a large waterplane area in the wave zone are generally undesirable.

Inherent self-stability is provided when the center of gravity is located below the center of buoyancy. The combined weight of the superstructure, hull, payload, ballast and other elements may be arranged to lower the center of buoyancy, but such an arrangement may be difficult to achieve. One method to lower the center of gravity is the addition of fixed ballast below the center of buoyancy to counterbalance the weight of superstructure and payload. Structural fixed ballast such as pig iron, iron ore, and concrete, are placed within or attached to the hull structure. The advantage of such a ballast arrangement is that stability may be achieved without adverse effect on seakeeping performance due to a large waterplane area.

Self-stable structures have the advantage of stability independent of the function of mooring system. Although the heave seakeeping characteristics of self-stabilizing floating structures are generally inferior to those of tendon-based platforms, self-stabilizing structures may nonetheless be preferable in many situations due to higher costs of tendon-based structures.

Prior art floating structures have been developed with a variety of designs for buoyancy, stability, and seakeeping characteristics. An apt discussion of floating structure design considerations and illustrations of several exemplary floating structures are provided in U.S. Pat. No. 6,431,107, issued on Aug. 13, 2002 to Byle and entitled "Tendon-Based Floating Structure" ("Byle"), which is incorporated herein by reference.

Byle discloses various spar buoy designs as examples of inherently stable floating structures in which the center of gravity ("CG") is disposed below the center of buoyancy ("CB"). Spar buoy hulls are elongated, typically extending more than six hundred feet below the water surface when installed. The longitudinal dimension of the hull must be great enough to provide mass such that the heave natural period is long, thereby reducing wave-induced heave. However, due to the large size of the spar hull, fabrication, transportation and installation costs are increased. It is desirable to provide a structure with integrated superstructure that may be fabricated quayside for reduced costs, yet which still is inherently stable due to a CG located below the CB.

U.S. Pat. No. 6,761,508 issued to Haun on Jul. 13, 2004 and entitled "Satellite Separator Platform (SSP)" ("Haun"), which is incorporated herein by reference, discloses an offshore platform that employs a retractable center column. The center column is raised above the keel level to allow the platform to be pulled through shallow waters en route to a deep water installation site. At the installation site, the center column is lowered to extend below the keel level to improve vessel stability by lowering the CG. The center column also provides pitch damping for the structure. However, the center column adds complexity and cost to the construction of the platform.

Other offshore system hull designs are known in the art. For instance, U.S. Patent Application Publication No. 2009/0126616, published on May 21, 2009 in the name of Srinivasan ("Srinivasan"), shows an octagonal hull structure with sharp corners and steeply sloped sides to cut and break ice for arctic operations of a vessel. Unlike most conventional offshore structures, which are designed for reduced motions, Srinivasan's structure is designed to induce heave, roll, pitch and surge motions to accomplish ice cutting.

U.S. Pat. No. 6,945,736, issued to Smedal et al. on Sep. 20, 2005 and entitled "Offshore Platform for Drilling After or Production of Hydrocarbons" ("Smedal"), discloses a drilling and production platform with a cylindrical hull. The Smedal structure has a CG located above the CB and therefore relies on a large waterplane area for stability, with a concomitant diminished heave seakeeping characteristic. Although, the Smedal structure has a circumferential recess formed about the hull near the keel for pitch and roll damping, the location and profile of such a recess has little effect in dampening heave.

It is believed that none of the offshore structures of prior art are characterized by all of the following advantageous attributes: Symmetry of the hull about a vertical axis; the CG located below the CB for inherent stability without the requirement for complex retractable columns or the like, exceptional heave damping characteristics without the requirement for mooring with vertical tendons, and the ability for quayside integration of the superstructure and "right-side-up" transit to the installation site, including the capability for transit through shallow waters. A buoyant offshore structure possessing all of these characteristic is desirable.

Further, there is a need for improvement in offloading systems for transferring petroleum products from an offshore production and/or storage structure to a tanker ship. According to the prior art, as part of an offloading system, a small catenary anchor leg mooring (CALM) buoy is typically anchored near a storage structure. The CALM buoy provides the ability for a tanker to freely weathervane about the buoy during the product transfer process.

For example, U.S. Pat. No. 5,065,687, issued to Hampton on Nov. 19, 1991 and entitled "Mooring System," provides an example of a buoy in an offloading system. The buoy is anchored to the seabed so as to provide a minimum weathervane distance from the nearby storage structure. One or more underwater mooring tethers or bridles attach the CALM buoy to the storage structure and carry a product transfer hose therebetween. A tanker connects to the CALM buoy such that a hose is extended from the tanker to the CALM buoy for receiving product from the storage structure via the CALM buoy.

It would be advantageous for an offshore production and/or storage structure to provide the capability to receive a tanker or other vessel and have that vessel moor directly thereto with the ability for the vessel to freely weathervane about the offshore structure while taking on product. Such an arrangement obviates the need for a separate buoy and provides enhanced safety and reduced installation, operating and maintenance costs.

IDENTIFICATION OF OBJECTS OF THE INVENTION

A primary object of the invention is to provide a buoyant offshore structure characterized by all of the following advantageous attributes: Symmetry of the hull about a vertical axis; the center of gravity located below the center of buoyancy for inherent stability without the requirement for complex retractable columns or the like, exceptional heave damping characteristics without the requirement for mooring with vertical tendons, and a design that provides for quayside integration of the superstructure and "right-side-up" transit to the installation site, including the capability to transit through shallow waters.

Another object of the invention is to provide a method and apparatus for offshore drilling, production, storage and offloading from a single cost-effective buoyant structure.

Another object of the invention is to provide a method and apparatus for offshore drilling, production, storage and offloading that performs the activities of a semi-submersible platform, a tension leg platform, a spar platform, and a floating production, storage and offloading vessel in one multifunctional structure.

Another object of the invention is to provide a method and apparatus for offshore drilling, production, storage and offloading that provides improved pitch, roll and heave resistance.

Another object of the invention is to provide a method and offshore apparatus for storing and offloading oil and gas that eliminates the requirement for a separate buoy for mooring a transport tanker vessel during product transfer.

Another object of the invention is to provide a method and offshore apparatus for storing and offloading oil and gas that eliminates the requirement for a turret.

Another object of the invention is to provide a method and apparatus for offshore drilling, production, storage and offloading that uses a modular drilling package that can be removed and used elsewhere when production wells have been drilled.

Another object of the invention is to provide a simplified method and apparatus for offshore drilling, production, storage and offloading that provides for fine tuning of the overall system response to meet specific operating requirements and regional environmental conditions.

Another object of the invention is to provide a method and apparatus for offshore drilling, production, storage and offloading that provides for single or tandem offloading.

Another object of the invention is to provide a method and apparatus for offshore drilling, production, storage and offloading that provides a large storage capacity.

Another object of the invention is to provide a method and apparatus for offshore drilling, production, storage and offloading that accommodates drilling marine risers and dry tree solutions.

Another object of the invention is to provide a method and apparatus for offshore drilling, production, storage and offloading that can be constructed without the need for a graving dock, thereby allowing construction in virtually any fabrication yard.

Another object of the invention is to provide a method and apparatus for offshore drilling, production, storage and offloading that is easily scalable.

SUMMARY OF THE INVENTION

The objects described above and other advantages and features of the invention are incorporated, in a preferred embodiment, in an offshore structure having a hull symmetric about a vertical axis with an upper vertical side wall extending downwardly from the main deck, an upper inwardly tapered side wall disposed below the upper vertical wall, a lower outwardly tapered side wall disposed below the upper sloped side wall, and a lower vertical side wall disposed below the lower sloped side wall. The hull planform may have circular or polygonal cross-section.

The upper inward-tapering side wall preferably slopes at an angle with respect to the vessel vertical axis between 10 and 15 degrees. The lower outward tapering side wall preferably slopes at an angle with respect to the vessel vertical axis between 55 and 65 degrees. The upper and lower tapered side walls cooperate to produce a significant amount of radiation damping resulting in almost no heave amplification for any wave period. Optional fin-shaped appendages may be provided near the keel level for creating added mass to further reduce and fine tune the heave.

The center of gravity of the offshore vessel according to the invention is located below its center of buoyancy in order to provide inherent stability. The addition of ballast to the lower and outermost portions of the hull is used to lower the CG for various superstructure configurations and payloads to be carried by the hull. A heavy slurry of hematite or other heavy material and water may be used, providing the advantages of high density structural ballast with the ease and flexibility of removal by pumping, should the need arise. The ballasting creates large righting moments and increases the natural period of the structure to above the period of the most common waves, thereby limiting wave-induced acceleration in all degrees of freedom.

The height h of the hull is limited to a dimension that allows the structure to be assembled onshore or quayside using conventional shipbuilding methods and then towed upright to an offshore location.

The offshore structure provides one or more movable hawser connections that allow a tanker vessel to moor directly to the offshore structure during offloading rather than mooring to a separate buoy at some distance from the offshore storage structure. The movable hawser connection includes an arcuate track or rail. A trolley rides on the rail and provides a movable mooring padeye or hard point to which a mooring hawser connects and moors a tanker vessel.

BRIEF DESCRIPTION OF THE DRAWINGS

A better understanding of the invention can be obtained when the detailed description of exemplary embodiments set forth below is considered in conjunction with the attached drawings in which.

DESCRIPTION OF THE PREFERRED EMBODIMENTS OF THE INVENTION

Figure 1:
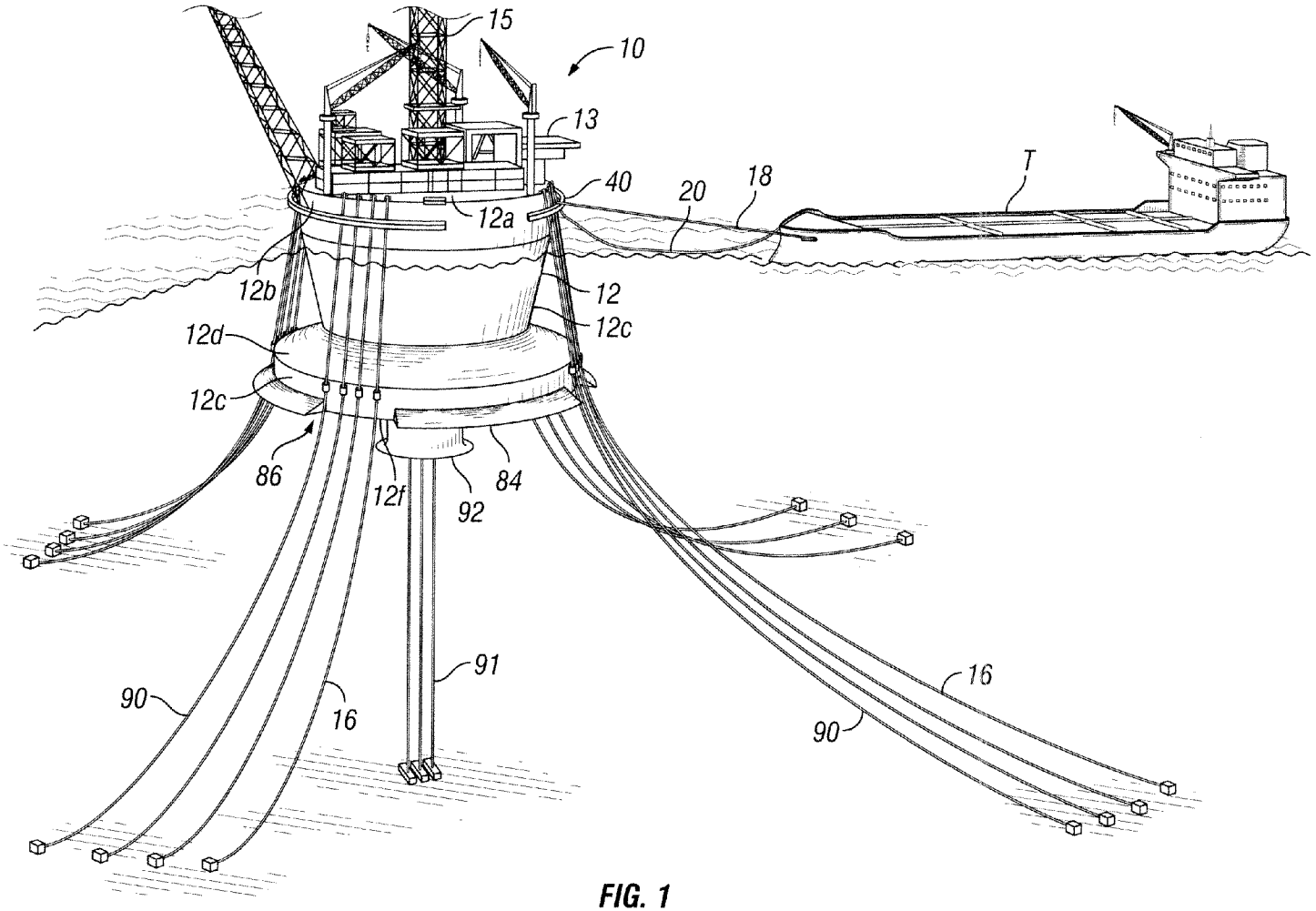
FIG. 1 is a perspective view of a buoyant offshore storage structure moored to the seabed and carrying production risers according to a preferred embodiment of the invention, shown with a superstructure carried by the storage structure to support drilling operations and with a tanker vessel moored thereto via a movable hawser system for transferring hydrocarbon product.

FIG. 1 illustrates a buoyant offshore structure 10 for production and/or storage of hydrocarbons from subsea wells according to a preferred embodiment of the invention. Offshore structure 10 includes a buoyant hull 12, which may carry a superstructure 13 thereon. Superstructure 13 may include a diverse collection of equipment and structures, such as living quarters for a crew, equipment storage, and a myriad of other structures, systems, and equipment, depending on the type of offshore operation to be performed. For example, a superstructure 13 for drilling a well includes a derrick 15 for drilling, running pipe and casing, and related operations.

Hull 12 is moored to the seafloor by a number of anchor lines 16. Catenary risers 90 may radially extend between structure 10 and subsea wells. Alternatively or additionally, vertical risers 91 may extend between the seafloor and hull 12. At keel level, a multifunctional center frame 86 may be provided to laterally and or vertically support one or more catenary or vertical risers 90, 91. The multifunctional center frame 86 may be integrated with hull 12 during construction of the hull, or it may be integrated in the center well of moon pool 26 (FIG. 3) and deployed after structure 10 is located at the installation site. The axial length of multifunctional center frame 86 is application dependant. The lower end of multifunctional center frame 86 is ideally flared outwardly for use as a riser landing porch. Multifunctional center frame 86 may be used in combination with center well moon pool 26, but a center well is not required. Multifunctional center frame 86 may be modified with minimal effect on the design of hull 12 and allows for flexibility in topsides layout.

A tanker vessel T is moored to floating structure 10 at a movable hawser connection assembly 40 via a hawser 18. Movable hawser connection assembly 40 includes an arcuate rail that carries a trolley thereon thus providing a movable hard point to which hawser 18 connects. Movable hawser connection assembly 40 allows vessel T to freely weathervane about at least a circumferential portion of offshore structure 10. A product transfer hose 20 connects offshore structure 10 to tanker vessel T for transferring hydrocarbon products.

In a preferred embodiment, hull 12 of offshore structure 10 has a circular main deck 12*a*, an upper cylindrical side portion 12*b* extending downwardly from deck 12*a*, an upper frustoconical side section 12*c* extending downwardly from upper cylindrical portion 12*b* and tapering inwardly, a lower frustoconical side section 12*d* extending downwardly and flaring outwardly, a lower cylindrical side section 12*e* extending downwardly from lower frustoconical section 12*d*, and a flat circular keel 12*f*. Preferably, upper frustoconical side section 12*c* has a substantially greater vertical height than lower frustoconical section 12*d*, and upper cylindrical section 12*b* has a slightly greater vertical height than lower cylindrical section 12*e*.

Figure 2:
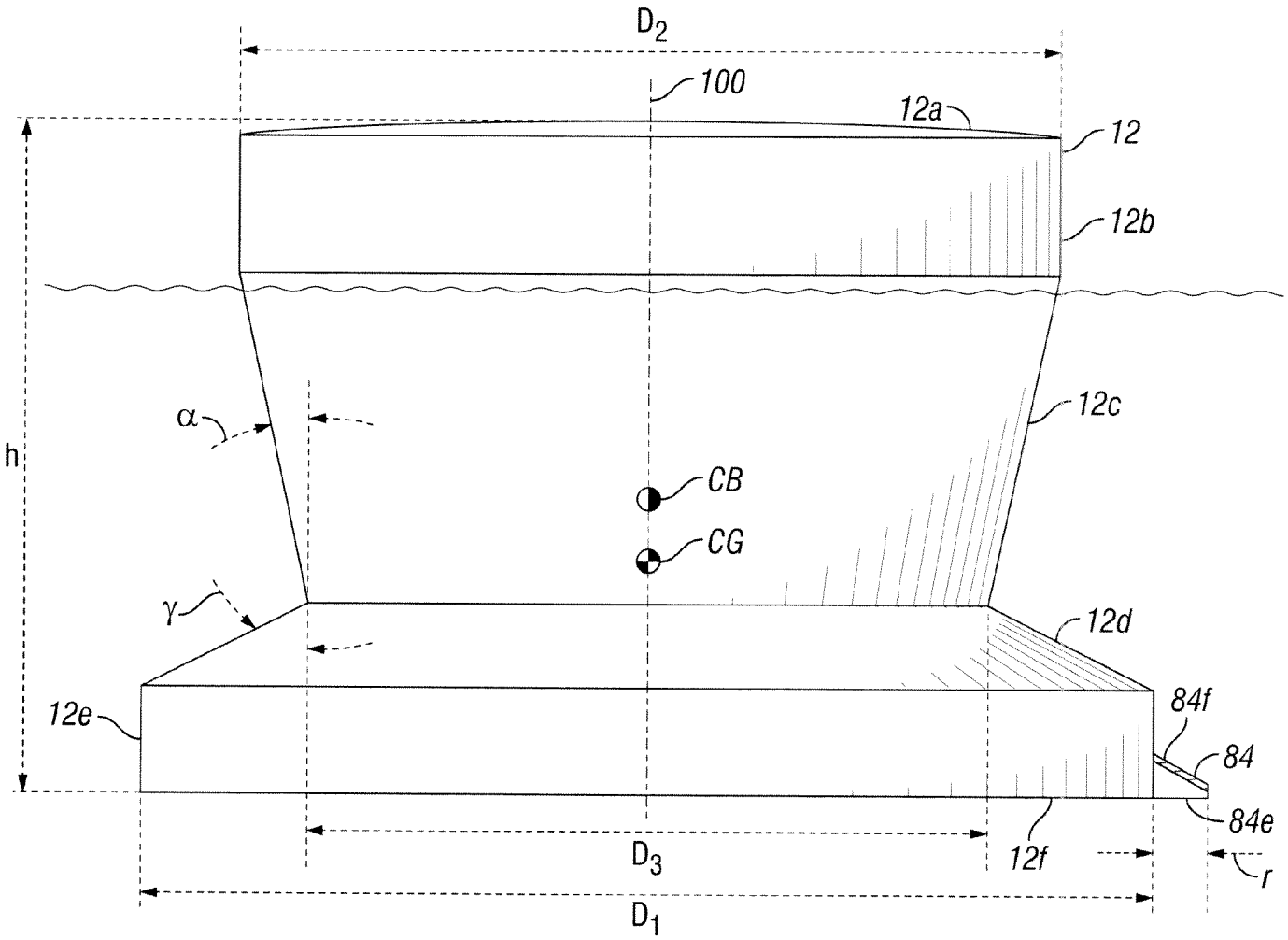
FIG. 2 is an axial cross-sectional drawing of the hull profile of the buoyant offshore storage structure according to a preferred embodiment of the invention, showing an upper vertical wall portion, an upper inwardly tapered wall section, a lower outwardly tapered wall section, and a lower vertical wall section.

Circular main deck 12*a*, upper cylindrical side section 12*b*, upper frustoconical side section 12*c*, lower frustoconical side section 12*d*, lower cylindrical section 12*e*, and circular keel 12*f* are all co-axial with a common vertical axis 100 (FIG. 2). Accordingly, hull 12 is characterized by a circular cross section when taken perpendicular to the axis 100 at any elevation.

Due to its circular planform, the dynamic response of hull 12 is independent of wave direction (when neglecting any asymmetries in the mooring system, risers, and underwater appendages). Additionally, the conical form of hull 12 is structurally efficient, offering a high payload and storage volume per ton of steel when compared to traditional ship-shaped offshore structures. Hull 12 preferably has round walls which are circular in radial cross-section, but such shape may be approximated using a large number of flat metal plates rather than bending plates into a desired curvature.

Although a circular hull planform is preferred, polygonal hull planforms may be used according to alternative embodiments, as described below with respect to FIG. 12. It is preferred, but not necessary, that structure 10 be symmetric or nearly symmetric about the vertical axis 100 to minimize wave-induced yaw forces.

FIG. 2 is a simplified view of the vertical profile of hull 12 according to a preferred embodiment of the invention. Such profile applies to both circular or polygonal hull planforms. The specific design of upper and lower sloped hull walls 12*c*, 12*d* generates a significant amount of radiation damping resulting in almost no heave amplification for any wave period, as described below.

Inward tapering wall section 12*c* is located in the wave zone. At design draft, the waterline is located on upper frustoconical section 12*c* just below the intersection with upper cylindrical side section 12*b*. Upper inward-tapering section 12*c* preferably slopes at an angle $\alpha$ with respect to the vessel vertical axis 100 between 10 and 15 degrees. The inward flare before reaching the waterline significantly dampens downward heave, because a downward motion of hull 12 increases the waterplane area. In other words, the hull area normal to the vertical axis 100 that breaks the water's surface will increase with downward hull motion, and such increased area is subject to the opposing resistance of the air/water interface. It has been found that 10-15 degrees of flare provides a desirable amount of damping of downward heave without sacrificing too much storage volume for the vessel.

Similarly, lower tapering surface 12*d* dampens upward heave. The lower sloping wall section 12*d* is located below the wave zone (about 30 meters below the waterline). Because the entire lower outward-sloping wall surface 12*d* is below the water surface, a greater area (normal to the vertical axis 100) is desired to achieve upward damping. Accordingly, the diameter $D_1$ of the lower hull section is preferably greater than the diameter $D_2$ the upper hull section. The lower outward-sloping wall section 12*d* preferably slopes at an angle $\gamma$ with respect to the vessel vertical axis 100 between 55 and 65 degrees. The lower section flares outwardly at an angle greater than or equal to 55 degrees to provide greater inertia for heave roll and pitch motions. The increased mass contributes to natural periods for heave pitch and roll above the expected wave energy. The upper bound of 65 degrees is based on avoiding abrupt changes in stability during initial ballasting on installation. That is, wall surface 12*d* could be perpendicular to the vertical axis 100 and achieve a desired amount of upward heave damping, but such a hull profile would result in an undesirable step-change in stability during initial ballasting on installation.

Figure 3:
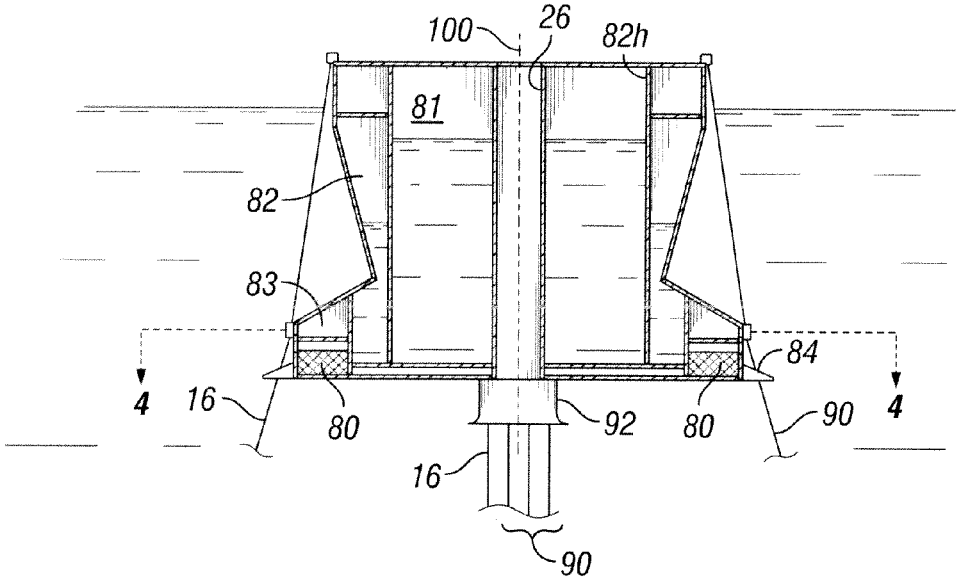
FIG. 3 is a view of the hull of the offshore storage structure of FIG. 1 in vertical cross-section along its longitudinal axis, showing an optional moon pool, fins mounted at or near keel level for fine tuning the dynamic response of the structure by controlling added mass, and internal compartmentalization including ring-shaped lower tanks ballasted with a hematite slurry, according to a preferred embodiment of the invention.
Figure 4:
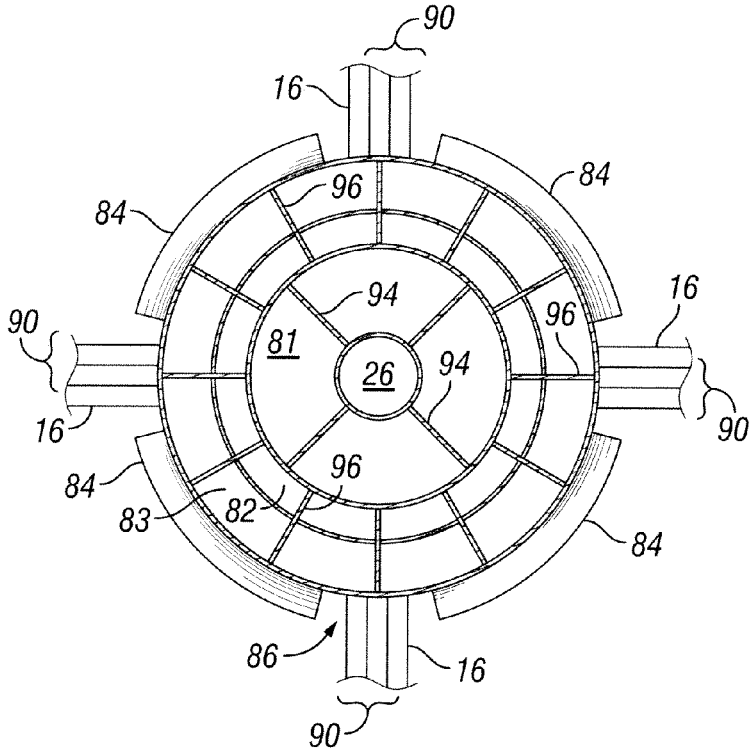
FIG. 4 is a radial cross-section of the hull of FIG. 3 taken along line 4-4 of FIG. 3, showing a plan view of the added mass fins and internal hull compartmentalization.

As illustrated in FIG. 2, the center of gravity of the offshore vessel 10 is located below its center of buoyancy to provide inherent stability. The addition of ballast to hull 12, as described below with respect to FIGS. 3 and 4, is used to lower the CG. Ideally, enough ballast is added to lower the CG below the CB for whatever superstructure 13 (FIG. 1) configuration and payload is to be carried by hull 12.

The hull form of structure 10 is characterized by a relatively high metacenter. But, because the CG is low, the metacentric height is further enhanced, resulting in large righting moments. Additionally, the peripheral location of the fixed ballast (discussed below with respect to FIGS. 3 and 4), further increases the righting moments. Accordingly, offshore structure 10 aggressively resists roll and pitch and is said to be "stiff." Stiff vessels are typically characterized by abrupt jerky accelerations as the large righting moments counter pitch and roll. However, the inertia associated with the high total mass of structure 10, enhanced specifically by the fixed ballast, mitigates such accelerations. In particular, the mass of the fixed ballast increases the natural period of the structure 10 to above the period of the most common waves, thereby limiting wave-induced acceleration in all degrees of freedom.

FIGS. 3 and 4 show one possible arrangement of ballast and storage compartments within hull 12. One or more compartments 80 together forming a ring shape (having a square or rectangular cross-section) is located in a lowermost and outermost portion of hull 12. Compartments 80 are, in a preferred embodiment, reserved for fixed ballasting to lower the CG of offshore structure 10. A heavy ballast, such as concrete loaded with a heavy aggregate of hematite, barite, limonite, magnetite, steel punchings, shot, swarf, other scrap, or the like, can be used. However, more preferably, a slurry of hematite and water, for example, one part hematite to three parts of water, is used. The heavy slurry of hematite and water provides advantages of high density structural ballast with the ease and flexibility of removal by pumping, should the need arise.

Hull 12 includes other ring-shaped compartments for use as voids, ballasting, or hydrocarbon storage. An inner annular tank 81 surrounds optional moon pool 26 and includes one or more radial bulkheads 94 for structural support and either compartmentalization or baffling. Two outer, annular compartments having outside walls conforming to the shape of the outer walls of hull 12 surround compartment 81. Compartments 82 and 83 include radial bulkheads 96 for structural support and compartmentalization, thereby allowing for fine trim adjustment by adjusting tank levels.

FIGS. 3 and 4 also show detail of optional fin-shaped appendages 84 used for creating added mass and for reducing heave and otherwise steadying offshore structure 10. The one or more fins 84 are attached to a lower and outer portion of lower cylindrical side section 12*e* of hull 12. As shown, fins 84 comprise four fin sections separated from each other by gaps 86. Gaps 86 accommodate catenary production risers 90 and anchor lines 16 on the exterior of hull 12 without contact with fins 84.

Referring back to FIG. 2, a fin 84 for reducing heave is shown in cross-section. In a preferred embodiment, fin 84 has the shape of a right triangle in a vertical cross-section, where the right angle is located adjacent a lowermost outer side wall of lower cylindrical section 12*e* of hull 12, such that a bottom edge 84*e* of the triangle shape is co-planar with the keel surface 12*f*, and the hypotenuse 84*f* of the triangle shape extends from a distal end of the bottom edge 84*e* of the triangle shape upwards and inwards to attach to the outer side wall of lower cylindrical section 12*e*.

The number, size, and orientation of fins 84 may be varied for optimum effectiveness in suppressing heave. For example, bottom edge 84*e* may extend radially outward a distance that is about half the vertical height of lower cylindrical section 12*e*, with hypotenuse 84*f* attaching to lower cylindrical section 12*e* about one quarter up the vertical height of lower cylindrical section 12*e* from keel level. Alternatively, with the radius R of lower cylindrical section 12*e* defined as $D_1/2$, then bottom edge 84*e* of fin 84 may extend radially outwardly an additional distance r, where $0.05R \geqq r \geqq 0.20R$, preferably about $0.10R \geqq r \geqq 0.15R$, and more preferably $r \approx 0.125R$. Although four fins 84 of a particular configuration defining a given radial coverage are shown in FIGS. 3 and 4, a different number of fins defining more or less radial coverage may be used to vary the amount of added mass as required. Added mass may or may not be desirable depending upon the requirements of a particular floating structure. Added mass, however, is generally the least expensive method of increasing the mass of a floating structure for purposes of influencing the natural period of motion.

In a preferred embodiment, offshore structure 10 has a diameter $D_1$ of 121 in, $D_2$ of 97.6 m, and $D_3$ of 81 m, a height h 79.7 m, a draft of 59.4 m, a displacement of 452,863 metric tons, and a storage capacity of 1.6 MBbls. Such structure is characterized by a heave natural period of 23 s and a roll natural period of 32 s. However, offshore structure 10 can be designed and sized to meet the requirements of a particular application. For example, the above dimensions may be scaled using the well known Froude scaling technique. For example, a scaled down offshore structure may have a diameter $D_2$ of 61 m, a draft of 37 m, a displacement of 110,562 metric tons, a heave natural period of 18 s and a roll natural period of 25 s.

It is desired that the height h of hull 12 be limited to a dimension that allows offshore structure 10 to assembled onshore or quayside using conventional shipbuilding methods and towed upright to an offshore location. Once installed, anchor lines 16 (FIG. 1) are fastened to anchors in the seabed, thereby mooring offshore structure 10 in a desired location.

Figure 5:
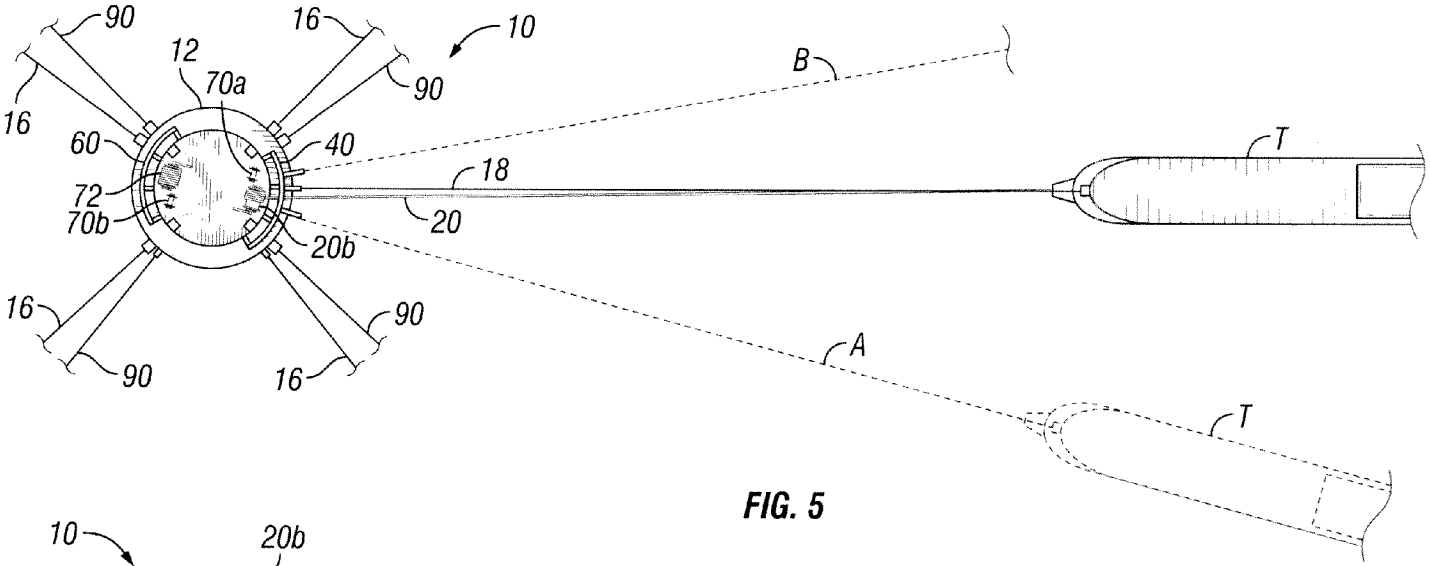
FIG. 5 is a simplified plan view of the storage structure of FIG. 1 with the drilling superstructure of the storage structure removed to reveal enlarged details of a movable hawser and offloading system, showing (in phantom lines) the tanker vessel of FIG. 1 freely weathervaning about the storage structure.
Figure 6:
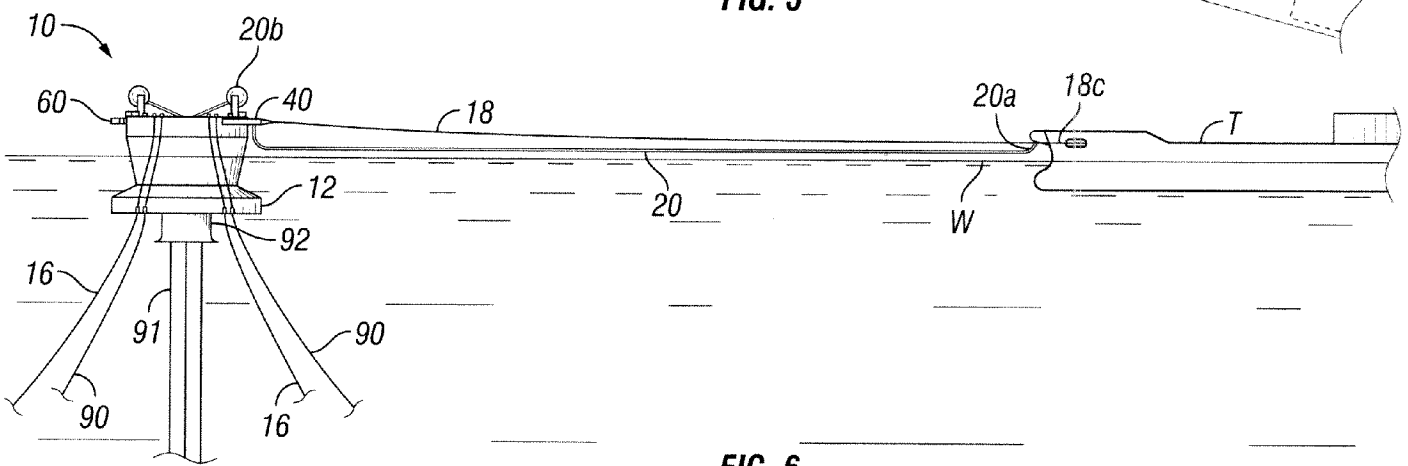
FIG. 6 is an elevation of the storage structure and tanker vessel of FIG. 5, showing catenary anchor mooring lines, optional production risers extending vertically to the center keel of the structure and being received within a riser landing porch, and optional catenary risers disposed radially about the structure hull.
Figure 7:
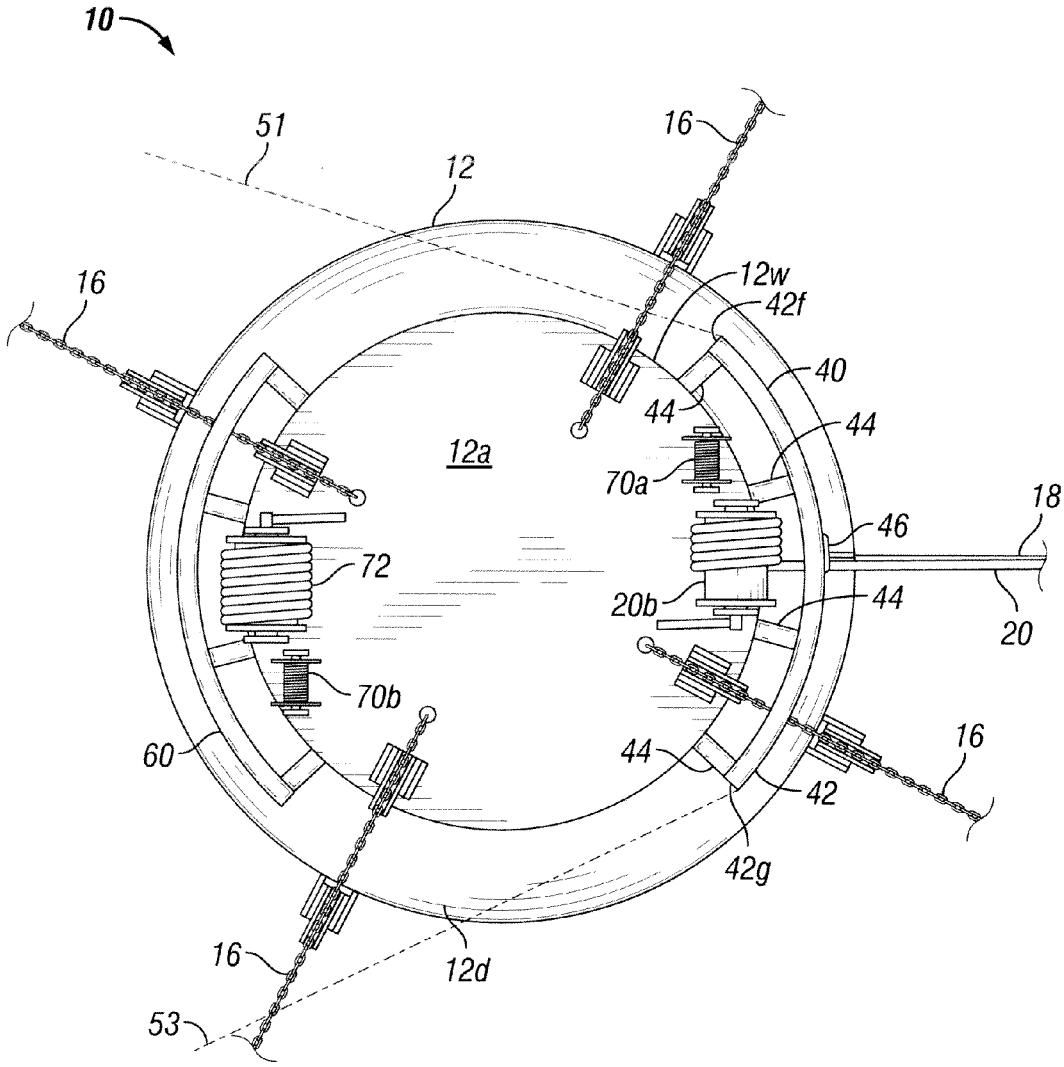
FIG. 7 is an enlarged and detailed plan view of the offshore storage structure of FIG. 5, showing a movable hawser and offloading system according to a preferred embodiment of the invention.
Figure 8:
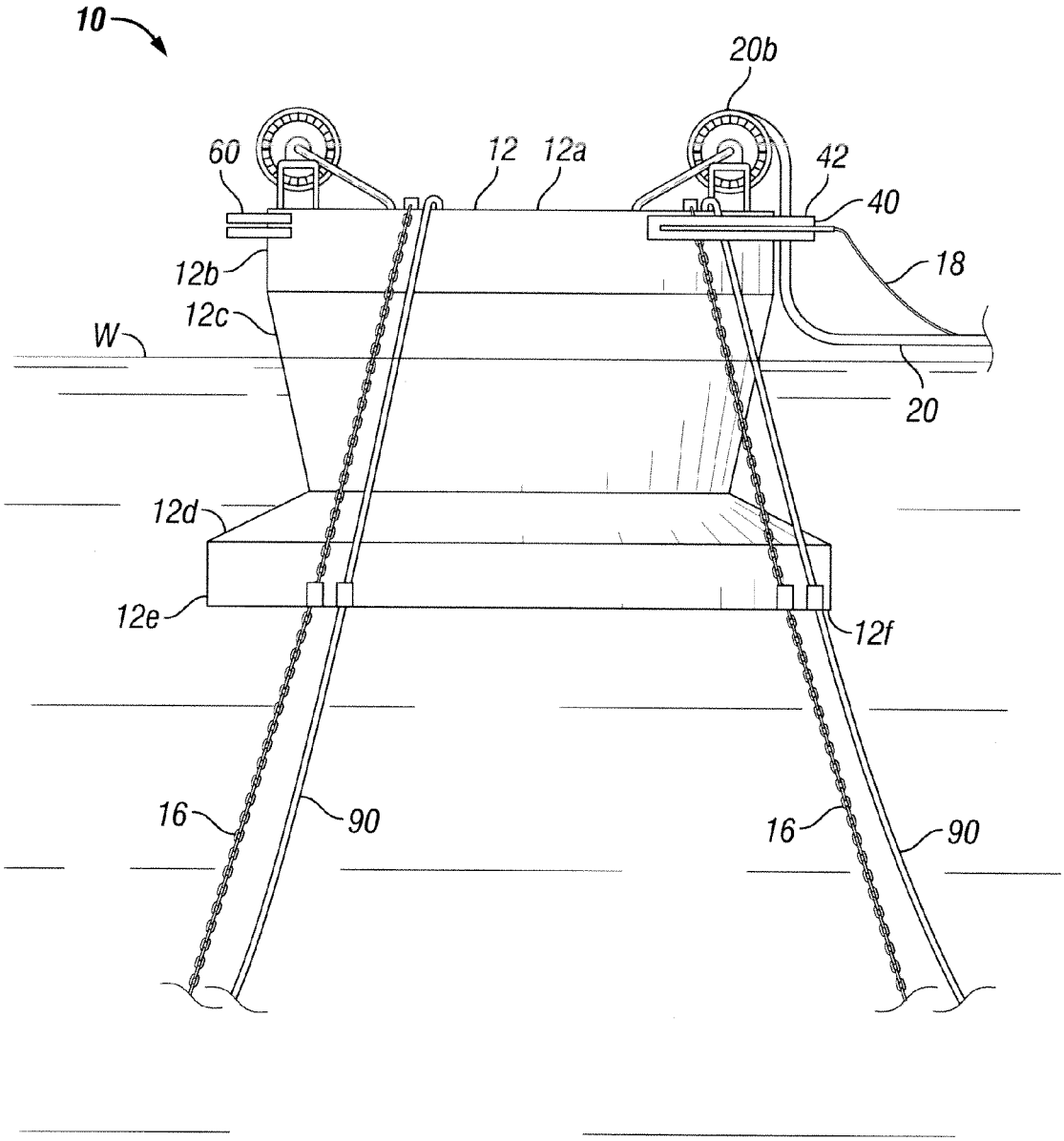
FIG. 8 is a detailed elevation drawing of the offshore storage structure of FIG. 7.

Offshore structure 10 of FIG. 1 is shown in plan view in FIGS. 5 and 7 and in side elevation in FIGS. 6 and 8. In a typical application, crude oil is produced from a subsea well (not illustrated), transferred into and stored temporarily in hull 12, and later offloaded to a tanker T for further transport to onshore facilities. Tanker T is moored temporarily to offshore structure 10 during the offloading operation by a hawser 18, which is typically synthetic or wire rope. A hose 20 is extended between hull 12 and tanker T for transfer of well fluids from offshore structure 10 to tanker T.

One procedure for mooring tanker T to offshore structure 10 is now described in greater detail. To offload a fluid cargo that has been stored in offshore structure 10, transport tanker T is brought near the offshore structure. With reference to FIGS. 5-8, a messenger line is stored on reels 70*a* and/or 70*b*. A first end of a messenger line is shot with a pyrotechnic gun from offshore structure 10 to tanker T and received by personnel on tanker T. The other end of the messenger is attached to a tanker end 18*c* of hawser 18. The personnel on the tanker can pull hawser end 18*c* of hawser 18 to the tanker T, where it is attached to a padeye, bits or other hard point on tanker T. The personnel on tanker T then shoot one end of a messenger line to personnel on the offshore structure 10, who hook that end of the messenger to a tanker end 20*a* of hose 20. Personnel on the tanker then pull hose 20 to the tanker and connect it to a fluid port on the cargo transfer system. Typically, cargo will be offloaded from offshore structure 10 to tanker T, but the opposite can also be done, where cargo from tanker T is transferred to the offshore structure for storage.

During offloading operations, tanker T will weathervane about offshore structure 10 according to the vagaries of the surrounding environment. As described in greater detail below, weathervaning is accommodated on the offshore structure 10 through the moveable hawser connection 40, which allowing considerable movement of the tanker about the structure 10 without interrupting the offloading operation.

After completion of an offloading operation, the hose end 20*a* is disconnected from tanker T, and a hose reel 20*b* is used to reel hose 20 back into stowage on offshore structure 10. A second hose and hose reel 72 is ideally provided on the offshore structure 10 for use in conjunction with the second moveable hawser connection 60 on the opposite side of offshore structure 10. Tanker end 18*c* of hawser 18 is then disconnected, allowing tanker T to depart. The messenger line is used to pull tanker end 18*c* of hawser 18 back to the offshore structure.

The location and orientation of tanker T is affected by wind direction and force, wave action and force and direction of current. Because its bow is moored to offshore structure 10 while its stern swings freely, tanker T weathervanes about offshore structure 10. As depicted in FIG. 5, forces due to wind, wave and current change, tanker T may move to the position indicated by phantom line A or to the position indicated by phantom line B. Tugboats or an additional temporary anchoring system, neither of which is shown, can be used to keep tanker T a minimum, safe distance from offshore structure 10 in case of a change in net forces that would otherwise cause tanker T to move toward offshore structure 10.

As best seen in FIG. 7, movable hawser connection 40 preferably includes an arcuate track or rail 42. A trolley rides on rail 42 and provides a movable mooring padeye or hard point to which hawser 18 connects, thus allowing weathervaning of tanker vessel T. In one embodiment, tubular channel 42 extends in a 90-degree arc about hull 12, thus allowing unfettered weathervaning in an approximate 270 degree arc between lines 51 and 53. Tubular channel 42 has closed opposing ends 42*f*, 42*g* for providing stops for trolley 46. Tubular channel 42 has a radius of curvature that exceeds and parallels the radius of curvature of outside upper cylindrical wall 12*b* of hull 12. Standoffs 44 space tubular channel away from side 12*b* of hull 12. Hose 20, anchor line 16, and risers 90 (FIG. 1) may pass through a space defined between outer hull wall 12*b* and tubular channel 42.

For flexibility in accommodating wind direction, offshore structure 10 preferably has a second moveable hawser connection 60 positioned opposite of moveable hawser connection 40. Tanker T can be moored to either moveable hawser connection 40 or to moveable hawser connection 60, depending on which better accommodates tanker T downwind of offshore structure 10. Moveable hawser connection 60 is essentially identical in design and construction to moveable hawser 40 with its own slotted tubular channel and trapped, free-rolling trolley car having a shackle protruding through the slot in the tubular channel. Because each moveable hawser connection 40 and 60 is capable of accommodating movement of tanker T within about a 270-degree arc, a great deal of flexibility is provided for offloading operation with 360 degrees of weathervane capability. However, a different number of movable hawser connections covering various arcs may be provided. For example, a single hawser connection covering 360 degrees is within the scope of the invention.

Figure 9:
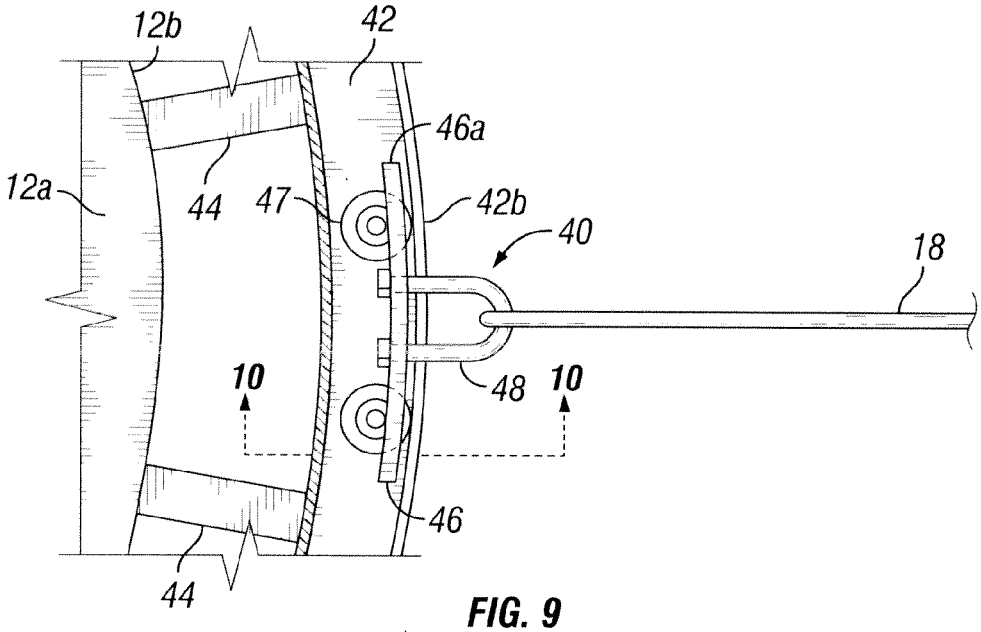
FIG. 9 is a detailed plan view of one of the moveable hawser connections illustrated in FIG. 7.
Figure 10:
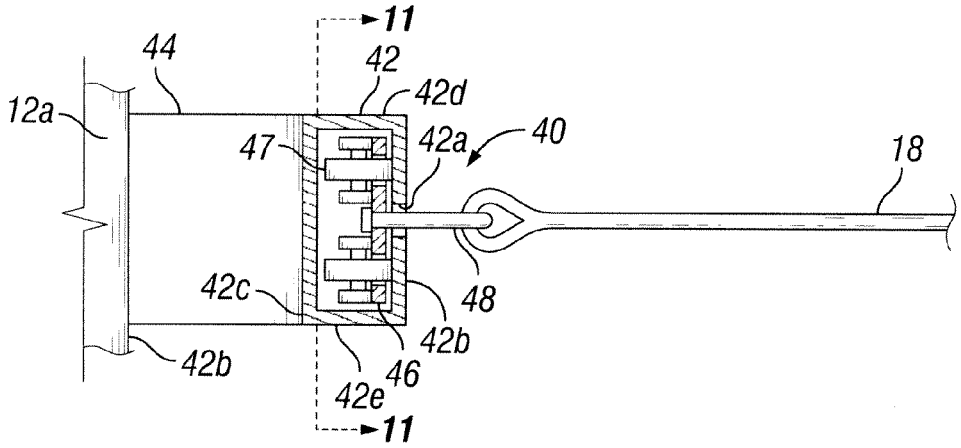
FIG. 10 is a detailed side view elevation in partial cross-section as seen along line 10-10 of FIG. 9 of the moveable hawser connection of FIG. 9.
Figure 11:
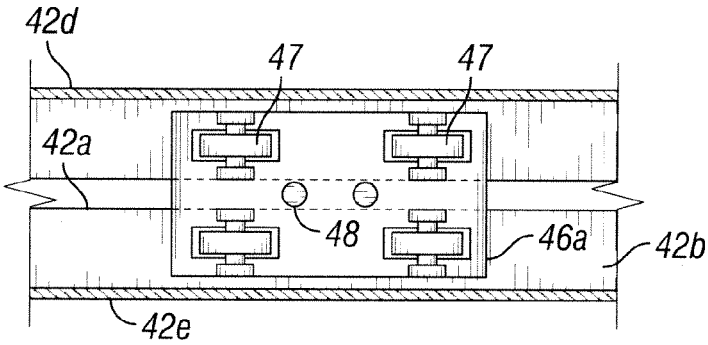
FIG. 11 is a detailed front view elevation in partial cross-section taken along line 11-11 of FIG. 10 of the moveable hawser connection of FIG. 9.

FIGS. 9-11 illustrate a moveable hawser connection 40 in detail according to the present invention. Moveable hawser connection 40 preferably includes a nearly fully enclosed tubular channel 42 that has a rectangular cross-section and a longitudinal slot 42*a* on the outboard side wall 42*b*. Standoffs 44 mount tubular channel 42 horizontally to upper vertical wall 12*b* of hull 12. A trolley 46 is captured by and moveable within tubular channel 42. A trolley shackle or padeye 48 is attached to trolley 46 and provides a hard connection point for hawser 18. As shipboard rigging is well known in the art, details of the hawser connection are not provided herein. Wall 42*b*, which has slot 42*a*, is a relatively tall, vertical outer wall, and an outside surface of an opposing inner wall 42*c* is equal in height. Stand-offs 44 are attached, such as by welding, to the outside surface of inner wall 42*c*. A pair of opposing, relatively short, horizontal walls 42*d* and 42*e* extend between vertical walls 42*b* and 42*c* to complete the enclosure of tubular channel 42, except vertical wall 42*b* has the horizontal, longitudinal slot 42*a* that extends nearly the full length of tubular channel 42. Trolley 46 includes a base plate 46*a*, which has four rectangular openings formed therethrough for receiving four wheels 47. Trolley 46 is free to roll back and forth within enclosed tubular channel 42 between ends 42*f* and 42*g*.

Wind, wave and current action can apply a great deal of force on tanker T, particularly during a storm or squall, which in turn applies a great deal of force on trolley 46 and tubular channel 42. Slot 42*a* weakens channel 42, and if enough force is applied, wall 42*b* can bend, possibly opening slot 42*a* wide enough for trolley 46 to be ripped out of its track. Tubular channel 42 is therefore preferably designed and built to withstand such forces. Inside corners within tubular channel 42 are ideally reinforced.

The tubular channel 42 described and illustrated in FIGS. 9-11 is just one arrangement for providing a moveable hawser connection 40. Any type of rail, channel or track can be used in the moveable hawser connection, provided a trolley or any kind of rolling, moveable or sliding device can move longitudinally but is otherwise trapped by the rail, channel or track. For example, an I-beam, which has opposing flanges attached to a central web, may be used as a rail instead of the tubular channel, with a trolley car or other rolling or sliding device captured and moveable on the I-beam. The following patents are incorporated by reference for all that they teach and particularly for what they teach about how to design and build a moveable connection: U.S. Pat. Nos. 5,595,121, entitled "Amusement Ride and Self-propelled Vehicle Therefor" and issued to Elliott et al.; 6,857,373, entitled "Variably Curved Track-Mounted Amusement Ride" and issued to Checketts et al.; 3,941,060, entitled "Monorail System" and issued to Morsbach; 4,984,523, entitled "Self-propelled Trolley and Supporting Track Structure" and issued to Define et al.; and 7,004,076, entitled "Material Handling System Enclosed Track Arrangement" and issued to Traubenkraut et al.

Figure 12:
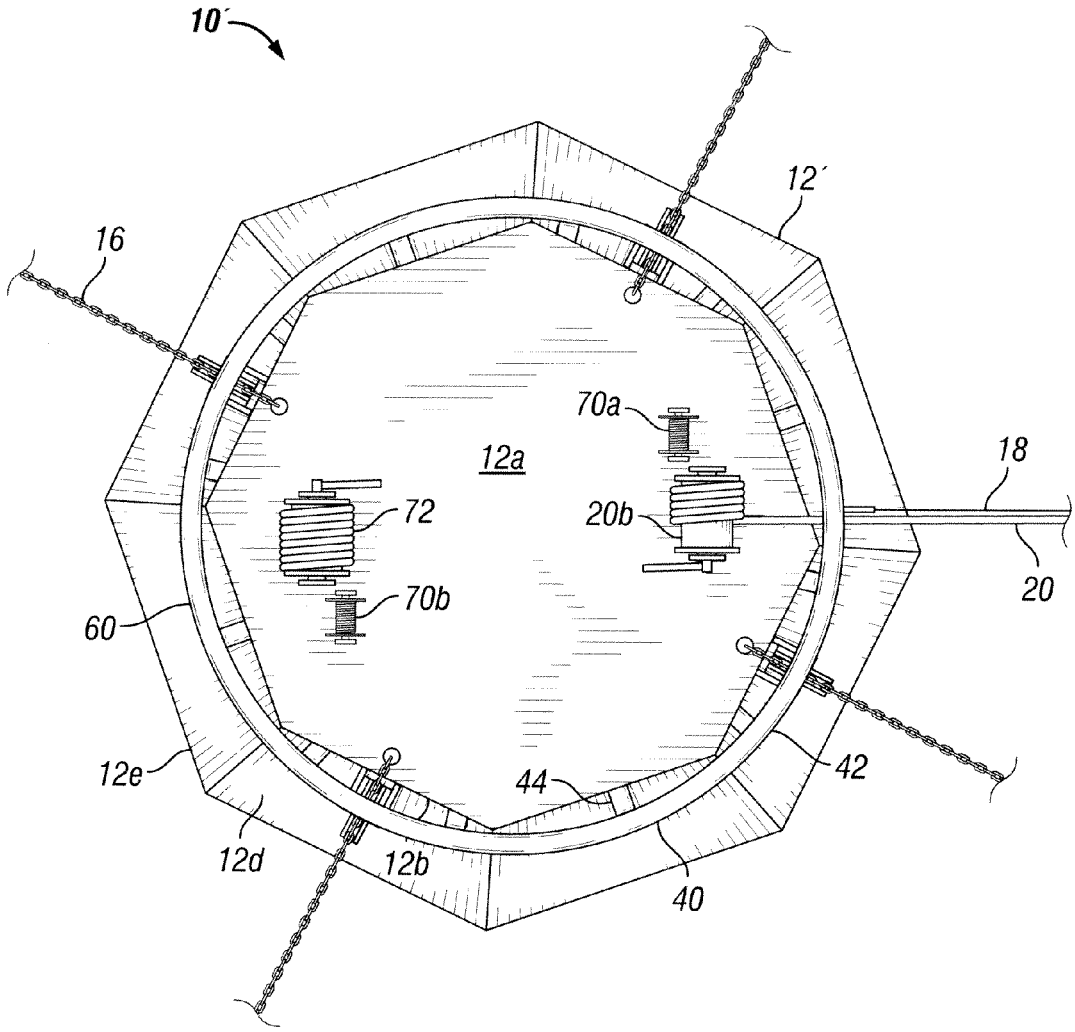
FIG. 12 is a simplified plan view of the offshore storage structure of FIG. 1 according to an alternate embodiment of the invention, showing a hexagonal hull planform and a 360 degree movable hawser connection.

FIG. 12 illustrates an offshore structure 10' having a hull 12' of a polygonal planform. One or more arcuate channels or rails 42 with an appropriate radius of curvature is mounted to the polygonal hull 12' with appropriate standoffs 44 so as to provide the moveable hawser connection 40. FIG. 12 illustrates a hexagonal hull, but any number of sides may be used as appropriate.

The Abstract of the disclosure is written solely for providing the United States Patent and Trademark Office and the public at large with a way by which to determine quickly from a cursory reading the nature and gist of the technical disclosure, and it represents solely a preferred embodiment and is not indicative of the nature of the invention as a whole.

While some embodiments of the invention have been illustrated in detail, the invention is not limited to the embodiments shown; modifications and adaptations of the above embodiment may occur to those skilled in the art. Such modifications and adaptations are in the spirit and scope of the invention as set forth herein:

What is claimed is:

1. A buoyant structure (10) for petroleum drilling, production, storage and offloading, comprising:

a hull (12) defining a vertical axis (100) whereby said hull (12) is characterized by circular horizontal cross-sections at all elevations, said hull characterized by an upper cylindrical portion (12*b*), an upper frustoconical portion (12*c*) directly connected to the bottom of said upper cylindrical portion (12*b*) so as to have inward-sloping walls at a first angle ($\alpha$) with respect to said vertical axis (100) between 10 and 15 degrees, a lower frustoconical portion (12*d*) disposed below said upper frustoconical portion (12*c*) and having outward-sloping walls at a second angle ($\gamma$) with respect to said vertical axis (100) between 55 and 65 degrees, a lower cylindrical portion (12*e*) directly connected to the bottom of said lower frustoconical portion (12*d*); a planar horizontal keel (12*f*) defining a lower hull diameter $D_1$, and a generally horizontal main deck (12*a*);

wherein said upper vertical wall section (12*b*) defines an upper hull diameter ($D_2$), said upper tapered wall section (12*c*) abuts said lower tapered wall section (12*d*) at a hull neck diameter ($D_3$), the height (h) of said hull (12), defined from said keel (12*f*) to said main deck (12*a*), is less than said hull neck diameter ($D_3$), said lower hull diameter ($D_1$) is the largest diameter of said hull, said hull neck diameter ($D_3$) is the smallest diameter ($D_3$) of said hull, said hull neck diameter ($D_3$) is between 75 and 90 percent of said upper hull diameter ($D_2$), and said lower hull diameter ($D_1$) is between 115 and 130 percent of said upper hull diameter ($D_2$); and wherein said structure (10) defines a center of gravity and a center of buoyancy, said center of gravity located below said center of buoyancy.

* * * * *